US009056288B2

(12) United States Patent
Greter et al.

(10) Patent No.: US 9,056,288 B2
(45) Date of Patent: Jun. 16, 2015

(54) MIXING APPARATUS FOR PRODUCING A MIXTURE COMPOSED OF AT LEAST THREE COMPONENTS

(75) Inventors: Andy Greter, Baar (CH); Mathey Vukic, Baar (CH)

(73) Assignee: MEDMIX SYSTEMS AG, Rotkreuz (CH)

( * ) Notice: Subject to any disclaimer, the term of this patent is extended or adjusted under 35 U.S.C. 154(b) by 0 days.

(21) Appl. No.: 13/265,465

(22) PCT Filed: May 11, 2010

(86) PCT No.: PCT/CH2010/000127

§ 371 (c)(1),
(2), (4) Date: Oct. 20, 2011

(87) PCT Pub. No.: WO2010/139078

PCT Pub. Date: Dec. 9, 2010

(65) Prior Publication Data

US 2012/0039147 A1 Feb. 16, 2012

(30) Foreign Application Priority Data

Jun. 5, 2009 (CH) ..... 867/09

(51) Int. Cl.
*B01F 15/02* (2006.01)
*B01F 5/06* (2006.01)
*B01F 13/00* (2006.01)

(52) U.S. Cl.
CPC ..... *B01F 5/061* (2013.01); *B01F 13/002* (2013.01); *B01F 13/0023* (2013.01); *B01F 2215/0027* (2013.01); *B01F 2215/0029* (2013.01)

(58) Field of Classification Search
USPC ..... 222/145.6, 459, 135–137; 366/158.5, 366/162.3, 181.5, 336–340, 181.8, 189
See application file for complete search history.

(56) References Cited

U.S. PATENT DOCUMENTS

| | | | | | |
|---|---|---|---|---|---|
| 227,780 | A | * | 5/1880 | Hodge | 222/132 |
| 829,127 | A | * | 8/1906 | Straus | 366/9 |
| 1,626,487 | A | * | 4/1927 | Warren | 366/163.2 |
| 2,460,605 | A | * | 2/1949 | Soissa | 222/14 |
| 2,486,200 | A | * | 10/1949 | O'Connor | 222/564 |
| 2,915,299 | A | * | 12/1959 | Woebcke | 366/98 |
| 3,635,444 | A | * | 1/1972 | Potter | 366/339 |
| 4,241,023 | A | * | 12/1980 | Wilke et al. | 422/187 |
| 4,443,109 | A | * | 4/1984 | Watts | 366/134 |

(Continued)

FOREIGN PATENT DOCUMENTS

| | | |
|---|---|---|
| DE | 92 07 048 U1 | 7/1992 |
| DE | 93 19 325 U1 | 2/1994 |

(Continued)

*Primary Examiner* — David Sorkin
*Assistant Examiner* — Abbas Rashid
(74) *Attorney, Agent, or Firm* — Sughrue Mion, PLLC

(57) ABSTRACT

A mixing apparatus for producing a mixture of flowable components is provided. Two inlet channels for the components to be mixed open into a first mixing channel having at least one mixing element disposed therein. A second mixing channel having at least one mixing element disposed therein is connected downstream of the first mixing channel. A third inlet channel opens directly or indirectly into the second mixing channel in order to admix a third component. In further embodiments, three or more mixing channels are present. In addition, a discharge comprising such a mixing apparatus and corresponding containers and a method for mixing at least three components are provided.

8 Claims, 1 Drawing Sheet

(56) References Cited

U.S. PATENT DOCUMENTS

| | | | | |
|---|---|---|---|---|
| 5,370,273 | A * | 12/1994 | Rohloff et al. | 222/132 |
| 5,909,959 | A * | 6/1999 | Gerich | 366/339 |
| 6,305,835 | B1 * | 10/2001 | Farrar et al. | 366/162.4 |
| 6,540,393 | B1 * | 4/2003 | Lyons et al. | 366/181.5 |
| 6,874,657 | B2 * | 4/2005 | Metzner et al. | 222/82 |
| 8,033,429 | B2 * | 10/2011 | Keller | 222/145.6 |
| 8,079,324 | B2 * | 12/2011 | Meyer | 118/411 |
| 2002/0048213 | A1 * | 4/2002 | Wilmer et al. | 366/136 |
| 2002/0104851 | A1 * | 8/2002 | Parise | 222/137 |
| 2003/0010792 | A1 * | 1/2003 | Forshey et al. | 222/56 |
| 2005/0051577 | A1 * | 3/2005 | Loeb et al. | 222/145.6 |
| 2005/0139610 | A1 * | 6/2005 | Crossdale et al. | 222/132 |
| 2007/0175921 | A1 * | 8/2007 | Keller | 222/137 |
| 2007/0278247 | A1 * | 12/2007 | Banks et al. | 222/132 |
| 2008/0029542 | A1 * | 2/2008 | Keller | 222/145.5 |
| 2008/0083782 | A1 * | 4/2008 | Heusser et al. | 222/145.5 |
| 2008/0089173 | A1 | 4/2008 | Lu et al. | |
| 2008/0203112 | A1 * | 8/2008 | Peuker et al. | 222/137 |
| 2009/0272759 | A1 * | 11/2009 | Bambrick et al. | 222/1 |

FOREIGN PATENT DOCUMENTS

| | | | |
|---|---|---|---|
| EP | 1498073 | B1 | 4/2008 |
| FR | 2 399 861 | | 3/1979 |
| FR | 2 416 718 | A1 | 9/1979 |
| GB | 1 423 933 | A | 2/1976 |
| WO | 2006/005205 | A1 | 1/2006 |

* cited by examiner

MIXING APPARATUS FOR PRODUCING A MIXTURE COMPOSED OF AT LEAST THREE COMPONENTS

CROSS REFERENCE TO RELATED APPLICATION

This application is a National Stage of International Application No. PCT/CH2010/000127 filed May 11, 2010, claiming priority based on Swiss Patent Application No. 00867/09, filed Jun. 5, 2009, the contents of all of which are incorporated herein by reference in their entirety.

TECHNICAL FIELD

The present invention relates to a mixing device, to a discharge device equipped with such a mixing device, and to a method for producing a mixture of flowable components.

PRIOR ART

An objective in many applications is to produce and discharge a mixture of several flowable components in a predefined mixing ratio. An example is the production of an adhesive for technical or medical uses, e.g. an epoxy resin adhesive or a medical glue based on fibrin, from two or more components. Another example is the production of a bone cement from several components. In systems of this kind, the curing time can be very short, and the product therefore has to be discharged immediately after being mixed.

To this end, the prior art discloses discharge devices in which two components that are to be mixed are stored in a double syringe with two syringe containers, two outlets and two interconnected syringe pistons, or are sucked into such a double syringe shortly before application. A mixing device with two inlet channels is then fitted onto the double syringe, said inlet channels adjoining the outlets of the double syringe. The inlet channels open into a mixing channel, in which a static mixing element is located, in most cases in the form of a mixing helix with helically arranged mixing blades. When the interconnected syringe pistons are then pushed into the double syringe, the two components are fed from the syringe containers into the mixing device, where they are mixed with each other and discharged immediately thereafter. A discharge device of this kind is known, e.g., from WO 2006/005205.

GB 1 423 933 discloses a mixing device for industrial applications, in which the mixing action for two components that are to be mixed is improved by means of two mixing channels, with mixing elements arranged therein, being routed in parallel in pairs. The outlets of the two mixing channels are brought together in a chamber. This chamber opens in turn into two parallel mixing channels which, with respect to the direction of flow, are offset by 90° in relation to the previous two mixing channels. This arrangement is repeated a number of times.

In certain applications, however, instead of just two components it may be necessary for three or more components to be mixed and then immediately discharged.

SUMMARY OF THE INVENTION

It is therefore an object of the present invention to make available a mixing device that permits the production and subsequent discharging of a mixture composed of at least three components.

It is thus proposed to carry out a sequential or serial mixing procedure in which the first two components are first of all mixed and then other components (which can optionally be a mixture themselves) are admixed. To this end, a through-flow mixing device for producing a mixture of flowable components is proposed which comprises:

- at least a first and a second inlet channel for the components to be mixed;
- an outlet channel for the mixture to be produced therefrom; and
- a first mixing channel arranged, in the direction of flow, between the inlet channels and the outlet channel and accommodating at least one mixing element, wherein the first and second inlet channels open directly or indirectly into the first mixing channel;
- a second mixing channel arranged, in the direction of flow, between the first mixing channel and the outlet channel and accommodating at least one mixing element, wherein the first mixing channel opens directly or indirectly into the second mixing channel, and
- at least a third inlet channel, which opens directly or indirectly into the second mixing channel.

The second mixing channel then opens directly or indirectly into the outlet channel of the mixing device.

In other words, a through-flow mixing device is thus proposed which, viewed in the direction of flow, has at least two flow mixers connected in series. At least two components are delivered to the first flow mixer and are mixed together in this flow mixer. Thereafter, in the second flow mixer, the resulting intermediate product has added to it at least one further component (which itself can also be an intermediate product). The terms "directly" and "indirectly" are to be understood as follows. A channel opens "directly" into another channel when there is no further mixer located between these channels. A channel opens "indirectly" into another channel when a further mixer is located between the channels, and in particular if further components are admixed in the further mixer.

The components should generally be flowable. This includes liquid, viscous and powdery components, if appropriate also gaseous components. The components can all be different, although it is also possible for two or more components to be identical. In particular, it is conceivable that the components delivered through the second and third inlet channels are identical, such that only the mixing ratio is changed between the first and second mixers. In this case, the third inlet channel can branch off from the second inlet channel.

At least the first and second inlet channels, preferably also the third inlet channel, preferably each have a connector element for a container. This connector element can be designed in any known way, e.g. as a male or female Luer connector. It is also conceivable to design a common connector element for all three or more channels. In this case, each inlet channel has a connection portion designed for connection to a container. To make connection easier, at least the first and second inlet channels, preferably also the third inlet channel, can extend parallel to one another in the area of the connector elements. The first, second and third inlet channels can be arranged substantially in a common plane in the area of the connector elements, although they can also form a triangle, for example. The connectors can be coded, i.e. differently designed, such that each connector can only be connected to a corresponding complementary connector of a matching container, or they can be designed and arranged such that the mixing device can be connected only in a well-defined position to a matching container arrangement.

The mixing elements in the mixing channels can be any desired static or dynamic mixing elements, as are known per se. In a preferred embodiment, the first and/or second mixing elements are static mixing elements. Mixing elements of this kind have long been known. They can, for example, comprise a helix with a plurality of helical blades or vanes arranged thereon.

In a particular embodiment, the mixing device also comprises a third mixing channel accommodating at least one mixing element, and a fourth inlet channel. The third inlet channel and the fourth inlet channel then open into the third mixing channel, and the third mixing channel opens directly or indirectly into the second mixing channel.

The invention also relates to a discharge device that comprises a mixing device of the type described above. The discharge device further comprises at least a first and a second container, wherein each container has a container outlet, and wherein the container outlet of the first container can be connected to the first inlet channel, and the container outlet of the second container can be connected to the second inlet channel. Preferably, a third container with a container outlet is also present, wherein this container outlet can be connected to the third inlet channel. Any desired containers can be used, e.g. syringes, carpules (i.e. containers that have a cylindrical wall portion and are closed at one end by a septum and at the other end by a movable piston), bags, tubes, etc. The containers can be accommodated in a common cartridge or can be connected to one another in some other way and form a single container unit. The container unit is then designed to be connected as a whole to the mixing device.

For this purpose, the inlet channels of the mixing device and the container outlets of the containers preferably have mutually corresponding connector elements or connection portions, which are designed and/or arranged in such a way that the container outlet of the first container can be connected only to the first inlet channel, and the container outlet of the second container can be connected only to the second inlet channel.

The discharge device preferably further comprises at least one discharge element in order to discharge the components from the containers and dispense said components through the container outlets. The discharge element can then usually be actuated manually. If the containers have a syringe-shaped or carpule-shaped design for example, the discharge element is, for example, a piston rod for each container. By contrast, if the containers are bag-shaped or collapsible tube-shaped for example, the discharge elements can also have completely different shapes. If several discharge elements are present, these are preferably connected to a common actuating element, so as to permit, by manual actuation of the actuating element, simultaneous dispensing of the components from the containers.

In a simple embodiment, each of the containers has a syringe-shaped design, with a syringe body having a cylindrical wall portion, and with a piston movable in the syringe body. The syringe bodies can then be rigidly interconnected in order to form a multiple syringe, and the pistons can be rigidly interconnected in order to ensure joint discharging from the syringes.

The quantities that are processed with a mixing and discharge device of this kind are normally small and vary within the range of about one to a few hundred milliliters. In other words, the containers normally have a volume of in each case less than about 300 ml. The sizes of the mixing device in each dimension usually reach at most about 30 cm, typically even less than 15 cm. The cross section of the mixing channels is typically less than about 5 $cm^2$.

According to a further aspect, the present invention relates to a method for producing a mixture of flowable components, said method comprising:

feeding a first and a second component through a first mixing channel accommodating at least one mixing element, in order to mix the first and the second component with each other to form a first intermediate product;

feeding the first intermediate product, together with a further component, through a second mixing channel accommodating at least one mixing element, in order to mix the first intermediate product together with the further component.

This method can be set up as an operating method for a device of the type described above, but it can also be carried out using other types of devices.

BRIEF DESCRIPTION OF THE DRAWINGS

Preferred embodiments of the invention are described below with reference to the drawings, which are provided only for illustration and are not to be interpreted as limiting the invention. In the drawings:

FIG. 1*b* shows an enlarged view of the mixing device from FIG. 1*a.

DESCRIPTION OF PREFERRED EMBODIMENTS

Figure 1A:
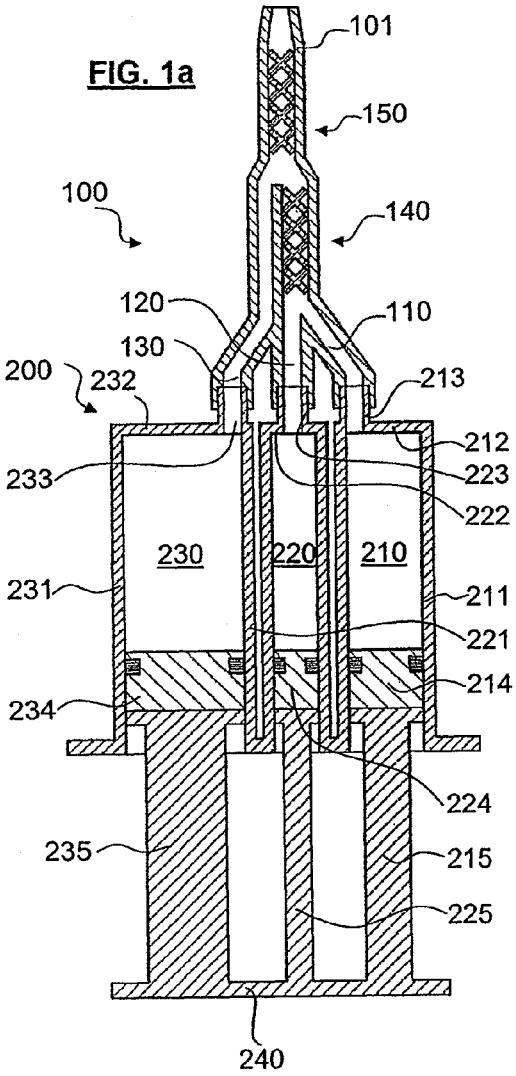
FIG. 1*a* shows, in longitudinal section, a highly schematic view of a discharge device with mixing device according to a first embodiment.
Figure 1B:
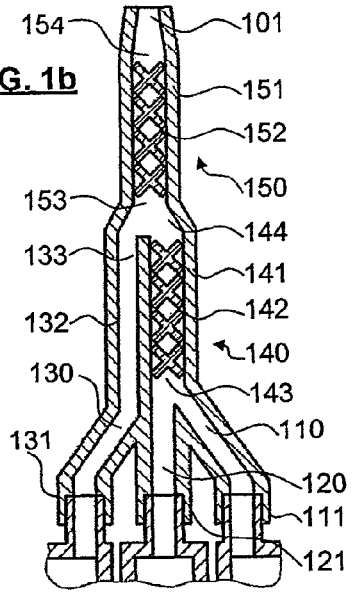

FIGS. 1*a* and 1*b* show highly schematic views of a discharge device in longitudinal section. The discharge device comprises a container unit in the form of a multiple syringe 200 (here a triple syringe) with three rigidly interconnected containers 210, 220 and 230 in the form of syringe bodies, which are closed by pistons 214, 224, 234. In the present example, the containers are arranged next to one another in a common plane, but they can also have another arrangement. The containers can have identical cross sections or, as in the present example, different cross sections and, therefore, also different volumes. Each syringe body has a cylindrical jacket wall 211, 221, 231, and a top wall 212, 222, 232 which delimits the syringe body in the distal direction and in each of which a container outlet 213, 223, 233 is formed. A piston 214, 224, 234 is inserted from the proximal direction into each syringe body and provides a seal with the jacket wall. A piston rod 215, 225, 235 is connected to each piston. At their proximal end, the piston rods are rigidly interconnected by a common actuating element 240, here in the form of an actuating flange.

A mixing device 100 is mounted on the container outlets 213, 223, 233. The mixing device has three inlet channels 110, 120, 130, of which the proximal end portions extend parallel to one another and, in the present example, are designed as connectors 111, 121, 131 (FIG. 1*b*) for fitting onto the multiple syringe 200. The connectors are only shown very schematically here. Many different types of connectors are conceivable here, e.g. standardized Luer connectors with the customary frustoconical contact surfaces and with or without a securing nut (Luer lock). The connectors are preferably coded, i.e. designed such that the mixing device can be fitted only in a well-defined position onto the multiple syringe, e.g. by choosing different diameters of the connectors or defined combinations of male and female connectors.

Of course, completely different types of connectors and codings are also possible that permit a defined connection between the outlet of each container and the associated inlet channel.

The first inlet channel 110 and the second inlet channel 120 open into a first mixing channel 141. Before the inlet portion 143 of the mixing channel 141, the two inlet channels 110, 120 run toward each other at an acute angle. However, it is also possible for the two inlet channels to be brought together in another way, e.g. parallel to each other or one surrounding the other in a ring shape, etc. The exact way in which the inlet channels are merged is not essential to the basic mode of operation of the mixing device.

The mixing channel 141 accommodates a static mixing element 142 which, together with the mixing channel 141, forms a first flow mixer 140. The mixing element is designed in the usual way as a mixing helix, wherein the helix has a plurality of successively disposed helical mixing blades by means of which the volume flow passing through the mixing channel is divided up, diverted and recombined a number of times in order to achieve thorough and optimally homogeneous mixing together of the mixing material. Mixing helices of this kind have long been known per se, and the exact nature of the mixing element is not essential to the basic mode of operation of the mixing device. Instead of a static mixer, it is also possible in principle to consider using a movable, externally driven mixing element, e.g. a rotatable mixing element.

At its outlet portion 144, the first mixing channel 141 opens into the inlet portion 153 of a second mixing channel 151 with a static mixing element 152. The second mixing channel 151 and the second mixing element 152 together form a second flow mixer 150. The latter can be constructed in the same manner as or in a different manner than the first mixer 140 and have the same or different dimensions, in particular length; the exact structure is once again not essential to the basic mode of operation of the mixing device.

The third inlet channel 130 extends, in a delivery section 132, parallel to the first mixing channel 141 and opens with a distal mouth portion 133 likewise into the inlet portion 153 of the second mixing channel 151. Once again, the outlet portion 144 of the first mixing channel 140 and the mouth portion 133 of the third inlet channel 130 can be brought together in any desired manner known per se.

In the present example, the outlet portion 154 of the second mixing channel 151 is adjoined directly by the outlet channel 101 of the mixing device 100, or this outlet channel is formed by the outlet portion 154. The outlet channel 101 can be provided with fastening means for attachment of an accessory, e.g. with a Luer cone for attachment of a spray device or of another accessory, or can itself be designed in any desired form, e.g. fan-shaped for a planar discharging of the mixing product. The exact configuration of the outlet portion is also not essential to the basic mode of operation of the mixing device.

In operation, the containers 210, 220, 230 are first of all filled with the components to be mixed and are vented, if this has not yet been done. Then the mixing device 100 is mounted on the multiple syringe. By manual pressure on the actuating element, the three pistons 214, 224 and 234 are pushed forward to the same extent, such that the components located in the containers pass through the outlets 213, 223, 233 of the containers into the inlet channels 110, 120, 130 of the mixing device. Here, the components from the first two containers 210, 220 are first of all brought together and mixed in the first mixer 140. The resulting intermediate product emerges from the first mixer 140 and is brought together with the third component from the container 230 and mixed in the second mixer 150. The resulting product is then discharged through the outlet channel 101. The components thus undergo sequential or serial mixing.

A mixing device of this kind can be advantageously used wherever a plurality of components are intended to be mixed together in succession. An example is the production of a bone cement from two components known per se, to which an active substance, e.g. a growth factor or an antibiotic, is to be admixed. The two cement components are in this case delivered through the first and second inlet channel and mixed in the first mixer, while the active substance is delivered through the second inlet channel and admixed in the second mixer. Another example involves two components of an adhesive system (e.g. two monomers), which are first of all mixed together in the first mixer and are then mixed together with a catalyst and/or promoter in the second mixer. Another possible application is one in which the viscosity of a mixture is intentionally influenced by admixture of a component through the third inlet channel. Many other applications are conceivable in which, for chemical or physical reasons, a defined sequence of mixing is necessary or desirable.

Although the three components to be mixed will be different in many applications, it is nonetheless also conceivable that the components in the second container and third container are identical, such that the component from the first container is first of all mixed in the first mixer with a smaller quantity of the other component, before the final mixing ratio is fixed in the second mixer. In this case, embodiments are also conceivable in which, instead of the third inlet channel being connected to a separate container, the second container opens with its outlet both into the second inlet channel and also into the third inlet channel, and these inlet channels are thus connected in the area of their proximal ends or branch off from a common inlet. This results in some of the component from the second container bypassing the first mixer.

It is also not strictly necessary for the components to be delivered from the three containers in a fixed and predetermined ratio, and instead the three pistons can also be advanced independently of one another or in an adjustable ratio of advance.

The mixing device can of course also be used with containers of other designs. Possible examples of such containers are: a cartridge which contains a plurality of containers and from which material is discharged via an integrated or independent actuating element; a tube arrangement; a bag system with flexible bags as containers, etc. The essential point is simply that each container has an outlet and that at least one discharge element is present that can be actuated in such a way that, upon actuation, the content is discharged from the container through the outlet. All the containers advantageously form a common unit.

Figure 2:
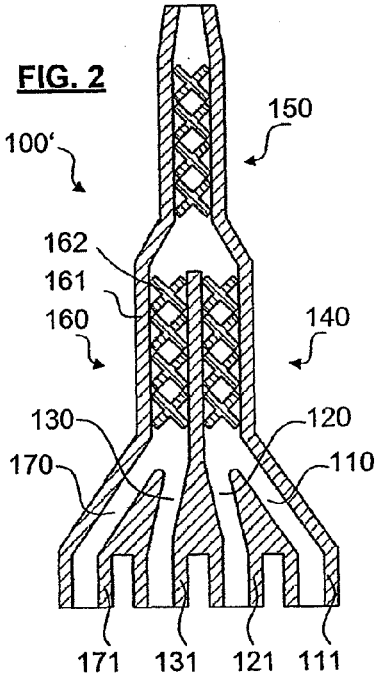
* and FIG. 2 shows a highly schematic view of a mixing device according to a second embodiment.

Another embodiment of a mixing device is shown in FIG. 2. Identical or corresponding parts are designated by the same reference numbers as in FIGS. 1*a* and 1*b*. This mixing device 100' has four inlet channels 110, 120, 130 and 170. The first two channels 110, 120 open into a first mixer 140. As in the previous illustrative embodiment, this mixer is followed downstream by a second mixer. The other two channels 130, 170 open into a third mixer 160 with mixing channel 161 and mixing element 162. The outlet portions of the first and third mixers open jointly into the second mixer.

In operation, the components from the first two inlet channels are fed through the first mixer 140, in order to mix these components together to form a first intermediate product, while the components from the other two inlet channels are fed through the third mixer, in order to mix these components together to form a second intermediate product. The first and second intermediate products are then fed through the second mixer 150 and mixed with each other. As before in the first illustrative embodiment, each mixer comprises a mixing channel and a mixing element arranged in the latter.

In the second illustrative embodiment too, many variations and modifications are once again possible.

Thus, in this case too, it is once again possible for two components to be identical, e.g. the components that pass through the inlet channels 120 and 130. These channels can accordingly also branch off from a common inlet. While a linear arrangement of the connectors of the mixing device is shown here, any other desired arrangement is also possible. Here too, the connectors can be designed such that they can be connected only in a very specific manner to a corresponding multiple container.

It is clear from the abovementioned examples that there are also many possible variations in respect of the arrangement of the individual mixers in the mixing device. Thus, instead of a two-stage sequential mixing procedure, it is also possible to provide a three-stage sequential mixing procedure in which at least three mixers are present, arranged one after another in the direction of flow, and in which a further component (which itself can once again be the intermediate product from a preceding mixing procedure) is admixed after each mixer. Thus, individual mixers can be combined with one another in substantially any desired topologies. Each individual mixer can also be designed to mix together not just two components but also three or more components in a single step.

LIST OF REFERENCE SIGNS

100, 100' mixing device
101 outlet channel
110 first inlet channel
111 first connector
120 second inlet channel
121 second connector
130 third inlet channel
131 third connector
132 delivery section
133 mouth portion
140 first mixer
141 first mixing channel
142 first mixing element
143 inlet portion
144 outlet portion
150 second mixer
151 second mixing channel
152 second mixing element
153 inlet portion
154 outlet portion
160 third mixer
161 third mixing channel
162 third mixing element
170 fourth inlet channel
171 fourth connector
200 multiple syringe
210 first container
211 jacket wall
212 top wall
213 outlet
214 piston
215 piston rod
220 second container
221 jacket wall
222 top wall
223 outlet
224 piston
225 piston rod
230 third container
231 jacket wall
232 top wall
233 outlet
234 piston
235 piston rod
240 actuating element

The invention claimed is:

1. A mixing device for producing a mixture of flowable components, said mixing device comprising:

a first, a second, a third and a fourth inlet channel for the components to be mixed, each of the first, second, third and fourth inlet channel having a connection portion for a container;

a first mixing channel accommodating a first mixing element;

a second mixing channel accommodating a second mixing element;

a third mixing channel accommodating a third mixing element;

an outlet channel for the mixture to be produced therefrom;

a first container having a first container outlet, the first container outlet being configured to be connected to the first inlet channel;

a second container having a second container outlet, the second container outlet being configured to be connected to the second inlet channel; and a third container having a third container outlet, the third container outlet being configured to be connected to the third inlet channel;

wherein each of the first, the second and the third mixing elements serves to achieve a thorough mixing of the components to be mixed, wherein the first and second inlet channels open into the first mixing channel, wherein the third and fourth inlet channels open into the third mixing channel, wherein each of the first and third mixing channels opens directly into the second mixing channel, wherein the second mixing channel opens into the outlet channel, and wherein each of the first, second and third containers has a syringe-shaped design, with a syringe body having a cylindrical wall portion, and with a piston movable in the syringe body.

2. The mixing device as claimed in claim 1, wherein at least the first and the second inlet channels extend parallel to each other in a region of the connection portions.

3. The mixing device as claimed in claim 1, wherein the first, second and third inlet channels are arranged substantially in a common plane in a region of the connection portions.

4. The mixing device as claimed in claim 1, wherein at least one of the first and second mixing elements is a static mixing element.

5. The mixing device as claimed in claim 4, wherein the static mixing element comprises a mixing helix.

6. The mixing device as claimed in claim 1, wherein the first mixing channel has a first inlet portion in which the first and second inlet channels open into the first mixing channel, and the third mixing channel has a second inlet portion in which the third and fourth inlet channels open into the third mixing channel, and wherein these first and second inlet portions are arranged in separate channels of the mixing device.

7. The mixing device as claimed in claim 1, wherein the first inlet channel has a first connector element and the first container outlet has a second connector element, the first and the second connector elements being mutually corresponding, wherein the second inlet channel has a third connector element and the second container outlet has a fourth connector element, the third and the fourth connector elements being mutually corresponding, and wherein the first, second, third and fourth connector elements are designed and/or arranged in such a way that the first container outlet can be connected only to the first inlet channel and the second container outlet can be connected only the second inlet channel.

8. The mixing device as claimed in claim 1, wherein the first, second and third containers together form a container unit in the form of a multiple syringe.

* * * * *